US005389750A

United States Patent [19]

Aigner et al.

[11] Patent Number: 5,389,750

[45] Date of Patent: Feb. 14, 1995

[54] TORQUE LIMITING DRIVE AND PROGRAMMER/TIMER EMPLOYING SAME

[75] Inventors: Robert K. Aigner, Norwood Park; Joseph J. Mahon, Libertyville, both of Ill.

[73] Assignee: Eaton Corporation, Cleveland, Ohio

[21] Appl. No.: 242,996

[22] Filed: May 16, 1994

Related U.S. Application Data

[63] Continuation of Ser. No. 13,501, Feb. 4, 1993, abandoned.

[51] Int. Cl.[6] ..... H01H 7/08; H01H 43/10

[52] U.S. Cl. ..... 200/38 R; 200/38 A; 200/38 C

[58] Field of Search ..... 200/27 B, 35 R, 38 R, 200/38 A, 38 FA, 38 FB, 38 B, 38 C

[56] References Cited

U.S. PATENT DOCUMENTS 3,214,529 10/1965 Druseikis et al. ..... 200/38
4,210,824 7/1980 Marquis et al. ..... 307/141
4,980,523 12/1990 Aigner et al. ..... 200/38 R

*Primary Examiner*—A. D. Pellinen
*Assistant Examiner*—Michael A. Friedhofer
*Attorney, Agent, or Firm*—Roger A. Johnston

[57] ABSTRACT

A torque limiting drive and programmer/timer using same. A motor drives a driving member which has drive lugs engaging the central web of a plural-armed wave spring. The wave spring arms frictionally engaged radially oppositely facing annular friction surfaces on a driven member, which in a programmer/timer is the program cam, which upon rotation of the cam is operative for sequentially actuating electrical switches. User rotation of the cam when the motor is not operative allows the wave spring arms to slip against the annular friction surfaces permitting the user to position the cam as desired.

7 Claims, 2 Drawing Sheets

TORQUE LIMITING DRIVE AND PROGRAMMER/TIMER EMPLOYING SAME

This application is a continuation of application Ser. No. 08/013,501, filed Feb. 4, 1993, now abandoned.

BACKGROUND OF THE INVENTION

The present invention relates to torque limiting drives, or friction clutches as they are sometimes called, of the type permitting slippage at torques above a predetermined level or value. Drivers of this type find application in timing mechanisms and programmer/timers for appliances. Devices of this type, and particularly programmer/timers for appliances typically utilize a small, sub-fractional horsepower timing motor driving an advance mechanism for advancing a rotating cam which sequentially actuates various electrical switches for effecting the various functional operations for the appliance service cycle or program.

Where an appliance is controlled by a timing motor advancing a rotary cam for sequentially actuating a plurality of switches, it is common practice to arrange the rotary cam such that it can be turned manually by the appliance user to a desired position representing a portion of the program prior to energizing the timing motor for beginning the appliance program cycle. Such an arrangement requires that the cam drum be rotated or advanced by the user against the friction forces of the cam followers for all of the switches and against the forces of the timer advancing mechanism or require that the advancing mechanism be released to permit such cam rotation by the user.

Heretofore, user rotation for program selection by rotating the of the appliance programmer/timer has resulted in difficulty in designing the program cam advance mechanism and the cam followers for the switches to permit such rotation without undue torque being applied by the user or without causing damage to the advance mechanism in the event of reverse rotation of the cam. Thus, it has been desired to provide a way or means of permitting the user to rotate the program cam of a timer motor advanced switching cam in an appliance programmer/timer without causing damage to the advance mechanism or presenting difficulties in the user manually applying the torque necessary to advance the cam against the friction forces of the switches.

SUMMARY OF THE INVENTION

The present invention provides a torque limiting friction drive or clutch mechanism having a driven member with oppositely facing annularly disposed friction surfaces arranged generally concentrically. A wave spring member frictionally engages both of the oppositely facing annular friction surfaces; and, driving lugs on a driving member axially engage the wave spring for driving the driven member upon application of power to the driving member. Upon user application of torque to the driven member when the drive is inoperative, the wave spring permits slippage on the friction surfaces to permit relative rotation between the driving and driven member. The wave spring of the present invention is assembled onto the driven member to perform a subassembly which facilitates assembly of the drive unit by requiring only axial engagement of the driving member lugs with the wave spring.

The programmer/timer of the present invention employs the torque limiting drive between the user torque input, which is to the driven member, to permit rotation of the driven member as the cam for actuating the function switches with respect to the driving member connected to a timer motor driven advance mechanism.

DETAILED DESCRIPTION

Figure 1:
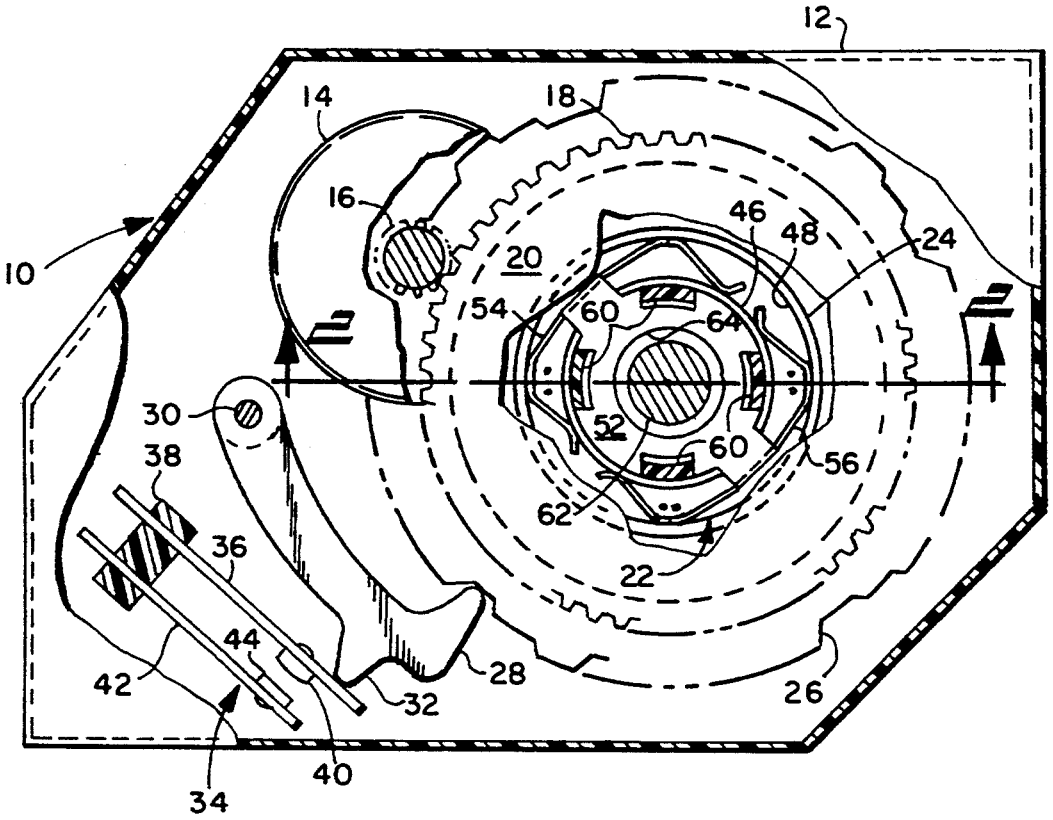
FIG. 1 is a plan view of a programmer/timer employing the present invention with portions of the casing removed.
Figure 2:
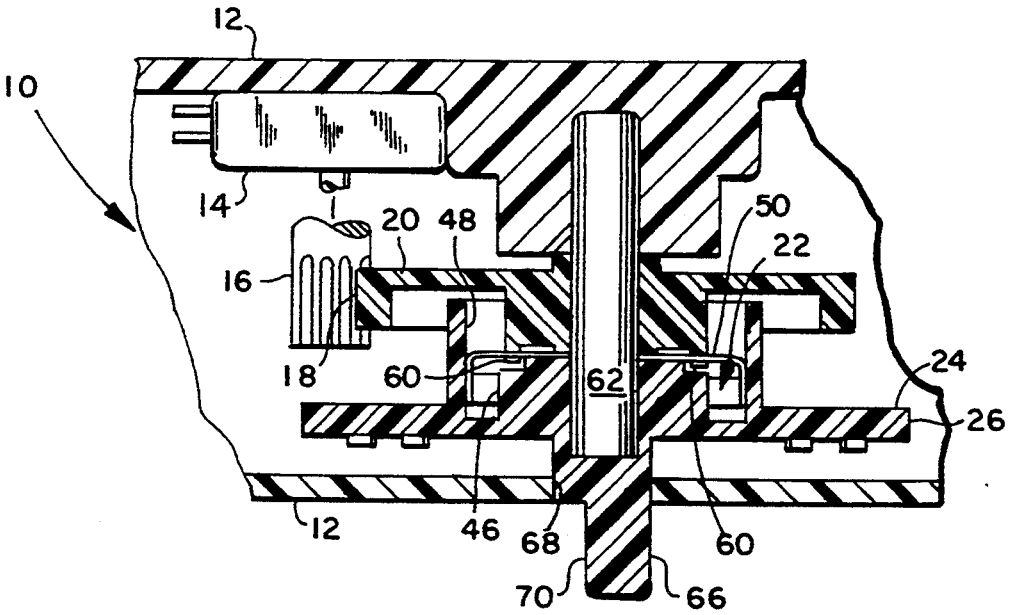
FIG. 2 is a portion of a section view taken along section indicating lines 2—2 of FIG. 1.
Figure 3:
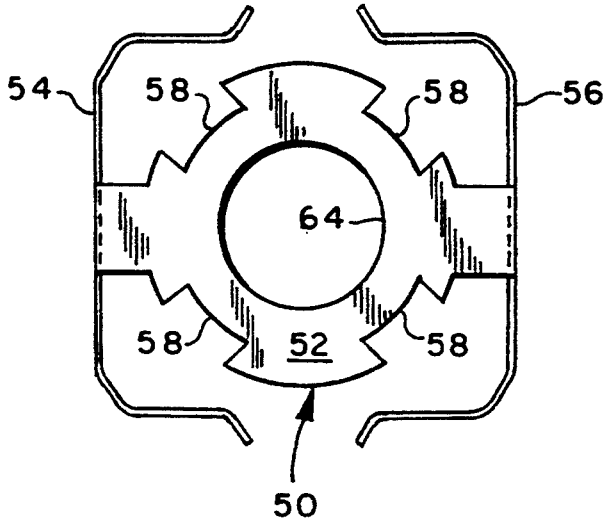
FIG. 3 is a plan view of the wave spring employed in the embodiment of FIG. 1.
Figure 4:
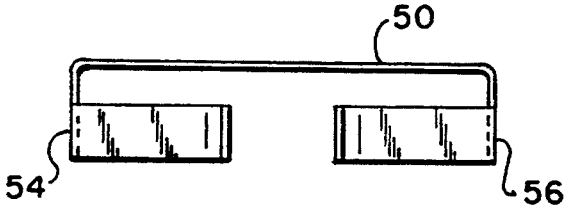
FIG. 4 is a front elevation view of the wave spring of FIG. 3.

Referring to FIG. 1 and FIG. 2, a programmer/timer employing the present invention is indicated generally at 10 and has a housing or base means 12 upon which is mounted a timing motor 14 which is operatively connected to the drive pinion 16, which engages peripheral teeth 18 provided about driving member 20.

Driving member 20 is connected by a torque limiting drive or friction clutch indicated generally at 22 to a driven member 24 which, in the embodiment of FIG. 1, has a cam track 26 formed about the periphery thereof, and which is engaged by a cam follower 28 pivotally mounted on base 12 by shaft 30. Cam follower 28 has an actuator portion 32 which contacts one blade 36 of a switch indicated generally at 34, which has blade 36 extending from mounting block 38 provided on the base 12 and which has one electrical contact 40 mounted thereon. A second blade 42 of switch 34 extends from block 38 and has a second electrical contact 44 mounted thereon which contact 44 is opened and closed against contact 40 as cam follower 28 moves in response to the rotation of cam track 26.

Referring to FIGS. 1 through 4, the torque limiting drive 22 comprises radially inner and radially outer oppositely facing annular surfaces 46, 48 provided on the driven member 24, and which are disposed concentrically thereon.

A spring member indicated generally at 50 is received on and frictionally engages the driven member 26 to form a subassembly. Spring 50 has a central radially-extending web 52 with oppositely disposed wave portions 54,56 formed integrally therewith and extending generally at right angles to the central web 52, with the wave portions having alternating portions thereof frictionally engaging the inner and outer annular surfaces 46,48. The central web 52 of the spring 50 has a plurality of torque transmitting surfaces in the form of cutouts 58 disposed about the circumference of the central web 52. The driving member has a plurality of lugs disposed circumferentially thereabout and denoted by reference numerals 60 in FIGS. 1 and 2, each of which engages one of the recesses 58 in the web 52 of the spring 50.

In the presently preferred practice, the driving member 20 and driven member 24 are journalled for rotation about shaft 62, which is mounted on the base means 12, and extends through a central opening 64 provided in the web 52 of spring 50.

A user torque input surface is provided on the driven member 26 in the form of a stub shaft 66 extending outwardly through an aperture 68 formed in the base 12 with a flat surface 70 provided on the stub shaft and adapted for receiving a knob thereon. Thus, upon user input torque applied to the flat surface 70, the driven member 26 rotates with respect to the wave spring portions 54,56 which slide frictionally along the surfaces 46,48 of the driving member, thereby permitting relative rotation of the driven member 24 with respect to the driving member 20 for positioning the cam 26 in the desired position.

Figure 5:
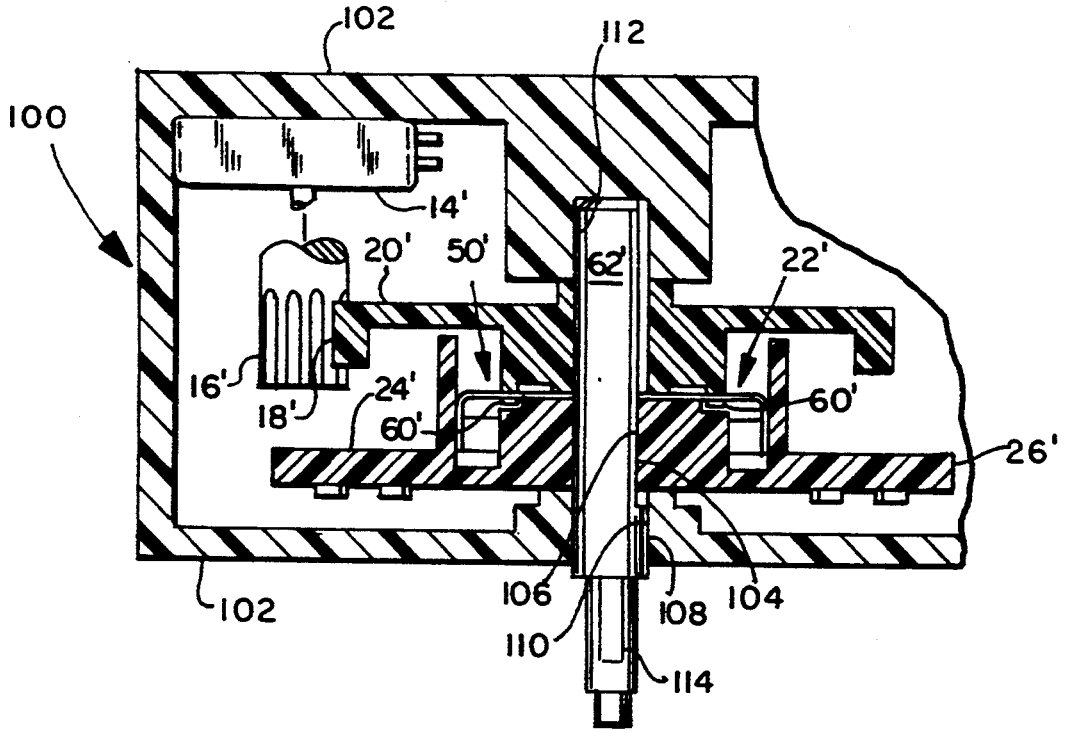
FIG. 5 is a section view similar to FIG. 2 of an alternate embodiment of the invention.

Referring to FIG. 5, an alternate embodiment of the invention is indicated generally at 100 and employs a housing 102 with timing motor 14' mounted therein driving pinion 16' which engages peripheral teeth 18' on driving member 20', which is identical to the member 20 in the embodiment of FIG. 2. Driving member 20' is journalled for free rotation about the shaft 62' mounted in blind bore 112 formed on the wall of the base 102. Shaft 62' extends outwardly through bore 110 formed in the opposite wall of the base 102, with exterior torque transmitting surfaces 114 provided thereon for user torque application to shaft 62'.

Shaft 62' has a flat 104 provided thereon which is engaged by the inner periphery 106 of a driven member 24' which is identical to the member 24 of the embodiment of FIG. 2, except for the flat surface 106 which engages shaft 62' flat surface 104. Driven member 24' has assembled therein a wave spring indicated generally at 50' which is otherwise identical to the wave spring 50 of the embodiment FIG. 2, and engages the concentric annular friction surfaces 46', 48' on driven member 24' in the same manner as in the FIG. 4 embodiment.

The wave spring 50' has recesses formed therein which are engaged in an axial direction by the lugs 60' provided on the driving member 20' in the same manner as described in the embodiment of FIG. 2. The embodiment of FIG. 5 thus utilizes the flat surface 106 of shaft 62' to transmit user applied torque to the shaft to the driven member surface 104' to effect relative rotation between driven member 24' and driving member 20' for positioning of the cam track 26' by the user when the motor drive is not in operation by frictional slippage of the wave spring with respect to the annular friction surfaces of the member 24'.

The present invention thus provides a simple, low-cost, easily assembled torque limiting drive or friction clutch which has particular application for advance mechanisms such as employed programmer/timers for appliances.

Although the invention has hereinabove been described here with respect to the embodiments illustrated in the drawings, it will be understood that the invention is capable of modification and variation by those skilled in the art, and is limited only by the scope of the following claims.

I claim:

1. A torque limiting drive assembly adapted for receiving a shaft comprising:

(a) a rotatable driving clutch member adapted for connection to a rotating source of power having thereon first axially engageable surfaces for rotary driving connection therewith;

(b) a driven clutch member having a first annular friction surface disposed on an inner periphery thereof and a second annular friction surface disposed concentrically within spaced radially from and facing said first annular surface;

(c) a spring member assembled onto said driven member and having outer portions thereof frictionally engaging said first annular friction surface and inner portions thereof engaging said second annular friction surface, said outer and inner portions disposed in circumferentially spaced alternating arrangement said driving member, said driven member and said spring member forming an assembly adapted for receiving a shaft, whereupon application of torque above a predetermined level to either of said driving or driven member causes rotary movement of said spring member with respect to said first and second friction surfaces.

2. The drive assembly defined in claim 1, wherein said first and second annular friction surfaces have a generally cylindrical configuration.

3. The drive defined in claim 1, wherein said spring member has central hub, said axially engageable driving surfaces and a radially extending web, said inner and outer portions extending in a circumferential direction from said web.

4. A programmer/timer comprising:

(a) base means;

(b) cam means disposed for rotary movement on said base means and including first and second radially spaced oppositely facing annular friction surfaces;

(c) cam follower means responsive to said rotary movement of said cam means for movement of said base means;

(d) switch means mounted on said base means responsive to said movement of said cam follower for opening and closing a set of electrical contacts;

(e) wave spring means mounted on said cam means having central portion defining torque transmitting surfaces and outer friction surfaces extending from said hub and disposed in a alternating arrangement in a circumferential direction;

(f) a driving member disposed for rotary movement on said base means having certain portions thereof engaging said torque transmitting surfaces of said wave spring means for transmitting torque thereto; and (g) motorized advance means drivingly connected to said driving member and operative to effect said rotary movement thereof, wherein upon application of sufficient torque to said cam means by the user, said wave spring means inner and outer portions are effective to slip against said first and second friction surfaces thereby permitting relative rotation between said cam means and said driving member.

5. The programmer/timer defined in claim 4, wherein said driving member comprises a gear and said certain portions thereof comprise a plurality of axially extending lugs.

6. The programmer/timer defined in claim 4, wherein said base means includes a shaft mounted thereon with said diving member journalled for rotation on said shaft.

7. The programmer/timer defined in claim 4, wherein said base means includes a shaft mounted thereon with said driving member and said cam means journalled for rotation on said shaft.

* * * * *